US005833475A

United States Patent [19]

Mitra

[11] Patent Number: 5,833,475

[45] Date of Patent: Nov. 10, 1998

[54] ELECTRICAL CONNECTOR WITH AN ELEMENT WHICH POSITIONS THE CONNECTION PINS

[75] Inventor: Niranjan Kumar Mitra, GH Eindhoven, Netherlands

[73] Assignee: Berg Technology, Inc., Reno, Nev.

[21] Appl. No.: 666,357

[22] PCT Filed: Sep. 12, 1994

[86] PCT No.: PCT/NL94/00313

§ 371 Date: Aug. 20, 1996

§ 102(e) Date: Aug. 20, 1996

[87] PCT Pub. No.: WO95/17775

PCT Pub. Date: Jun. 29, 1995

[30] Foreign Application Priority Data

Dec. 21, 1993 [NL] Netherlands ..... 9302227

[51] Int. Cl.[6] ..... H01R 9/09

[52] U.S. Cl. ..... 439/79

[58] Field of Search ..... 439/79, 80

[56] References Cited

U.S. PATENT DOCUMENTS 4,697,864 10/1987 Hayes et al. ..... 439/79

4,734,042 3/1988 Martens et al. ..... 439/62

5,593,307 1/1997 Bale et al. ..... 439/79

*Primary Examiner*—Neil Abrams

*Assistant Examiner*—T. C. Patel

*Attorney, Agent, or Firm*—Daniel J. Long; M. Richard Page

[57] ABSTRACT

An electrical connector, comprising a housing of electrically insulating material. The connector is provided with a number of contact elements of electrically conducting material, each with a contact end for contacting a further connector and an L-shaped connection pin for mounting on a printed circuit board. The connection pins consist of a fixed leg which at one end is immovably connected to the contact element and a free leg running at right angles to the fixed leg. The connector is also provided with a positioning element of electrically insulating material for holding the connection pins in the correct position. One side of the positioning element adjoins the connection pin output side. The fixed legs of the connection pins run through the bores of the positioning element, which is provided with a bending anvil for bending the connection pins to an L-shape.

10 Claims, 8 Drawing Sheets

IV
V
III
II

ELECTRICAL CONNECTOR WITH AN ELEMENT WHICH POSITIONS THE CONNECTION PINS

The invention relates to an electrical connector, comprising a housing of electrically insulating material with a connection side and a contact side, and provided with a number of contact elements of electrically conducting material accommodated in channels and, each with a contact end situated at the contact side of the housing, for contacting a further connector. and a connection end provided with an L-shaped connection pin, having a fixed leg fixed to the connection end of the contact element extending from the connection pin output side of the housing lying opposite the contact side, a bend and a free leg for mounting on a printed circuit board substantially perpendicular to the fixed leg and extending to beyond the connection side of the housing running at right angles to the connection pin output side, and comprising a bending anvil having a curved bending face for bending the connection pins to an L-shape.

So-called rectangular connectors, i.e. connectors with rectangular connection pins, are often asked for by consumers, in particular connectors with a small pitch distance. This makes it difficult to maintain the correct positions of the parts of the connection pins over the entire length of the connectors not only during manufacture, but also during packaging and transportation, in order to permit correct positioning of the soldering ends of the connection pins relative to holes in a printed circuit board. Additional complications are the curvature of the printed circuit board, and the correct position of the soldering ends of the connection pins, in particular when there is a small pitch distance, which is, of course, associated with holes of small diameter.

Another problem encountered in the production of the above-mentioned connectors with small pitch distance is accurate bending of the connection pins at right angles, in order to achieve the correct position of the soldering ends of the connection pins here.

In this connection it is observed that the invention pertains to a right-angle connector for miniaturized connector for high I/O applications. The right-angle tail is an extension of the terminal contact, and is of thin-stock (rectangular 0.35×0.15 mm width: thickness) material. By virtue of the close mutual spacings of tails 1.27×1.27 mm), end due to its slender configurations, without additional means such tails can be skew With large true-position in accuracy of pin-tip with respect to the theoretical 1.27×1.27 mm raster, even before the 90° bending. This situation becomes more aggravated after the bend. Such miniature connectors due to the delicate tails, results in in-advertent problems during placement on PC Boards.

Right-angle connectors are known from the U.S. Pat. Nos. 5,112,234 and 5,032,085 but in contrast to present invention these prior art reference pertain to relatively thick-stock material with round cross-section of tail. The U.S. Pat. No. 4,697,864 seems to pertain to connectors slightly corresponding to the connector of the invention. However, all the tails known from the prior art references are un-supported and free standing in air in the area of 90° bend zone.

The object of the invention is to provide an electrical connector of the type mentioned in the preamble, in which the above-mentioned problems are avoided and the connection pins can be bent in a simple and accurate way at such a right angle that the correct position of the connection ends of the connection pins is maintained even after the bending action and during transport.

Another aim of the inventor was to facilitate the fitting of the connector on printed circuit boards.

This object and aim are achieved according to the invention through the fact that the bending anvil is separated from the connector housing and is provided with a positioning element of electrically insulating material between the connection pin output side and the bending anvil, said positioning element has bores extending perpendicular to the plane of the connection pin output side of the connector housing for accommodating and supporting the fixed legs of the connection pins in all of its transverse directions during the bending operation; that the bores merge into the respective curved bending faces of the anvil such that the bore openings are immediately adjacent to the beginning of the corresponding curved bending faces; that the opposite bore openings are tappered and that the positioning element is provided with aligning and positioning means for aligning it to the connector housing.

Electrical connectors provided with a positioning element of electrically insulating material surrounding the connection pins for holding them in position are known per se in practice, and are often called "wafer" in the trade literature.

In practice two types of positioning elements surrounding the connection pins of a connector can be distinguished, viz. elements which essentially surround the connection ends of the connection pins, and elements extending between the connection pins over the entire connection side of the connector.

Elements of the first-mentioned type are known from U.S. Pat. No. 4,686,607, and their purpose is essentially to prevent deviations in the predetermined mutual pitch distance between the connection ends, e.g. as a result of bending thereof, during transportation or assembly of the connector, in order to facilitate the electrical connection of the connection ends of the pins in correspondingly situated apertures and/or to connection faces on a printed circuit board, which is advantageous in particular in the case of connectors with a large number of contact elements and in the case of mechanical mounting by means of e.g. an assembly robot.

The elements of the second type are known from U.S. Pat. No. 4,986,772, and provide not only the desired positioning of the connection ends of the connection pins, but also electrical and mechanical protection of the connection pins, so that e.g. short-circuiting between individuel connection pins is effectively prevented. Accidental contact of one or more connection pins can also be prevented effectively in this way. It will be clear that the elements of the second type are larger in size than the elements of the above-described first type. The elements of the second type can also be used to insert the contact elements into the housing.

In order to guarantee optimum positioning of the connection ends of the connection pins, it is advantageous to Keep the element as close as possible to the ends of the connection pins during transportation and assembly of the connectors. For mounting on a printed circuit board, the element must then be slid up along the connection ends, so that it tests on the board. The connection ends are then free for connection thereof to the corresponding connection faces of the printed circuit board.

The known positioning elements are, however, located after the bends of the connection pins.

First by locating the positioning element between the connection pin output Side of the connector and the anvil and by having the bores of the positioning element merges as directly as possible into the respective curve bending faces of the anvil the requisit pitch of the free pin tips is obtained.

This ensures that the soldering legs of the connection pins are aligned in the correct position before they are bent, following which they are bent accurately at an angle of 90°, and these correctly bent legs are then shielded and accommodated in the bending anvil.

The assembly, consisting of the connector, the positioning element and the anvil can then be placed as one unit on the printed circuit board without additional operations, prior to the soldering process.

The bending anvil is a separate component of the connector, so that the connector housing and the anvil can be produced of different materials. This is advantageous because for the connector housing a cheaper material can be selected than for the anvil. The anvil can be manufactured from material of higher quality in order to prevent the anvil from distortion during bending, while precise tolerances for the final shape of the bended tails can be met. Furthermore, the separate anvil has the advantage that it collects firstly all (possible mis-positioned) pin tips by rectangular (frustum) lead-in's located in front of anvil/holder.

By subsequent relative movement of anvil/holder towards back-end of connector, these gathered tails are guided to move into channels with a substantial straight portion; hence for the top row the tail is supported in the channel along four mutually perpendicular walls, and for lower row this support is at least on an "U". This ensures that the straight tail portion protruding beyond the anvil/holder, prior to the 90° bend, is accurately positioned in the X-Y plane besides the Z-plane. This is a pre-condition to ensure good pin-tip true-position after the 90° bend.

The bent portion of the tail is fully supported over a radiussed channel, and not left un-supported as in prior art to allow discrepancies of varying radius bends and local skew in this area.

A slanting chamfer 28 to appropriately engage with mass-bend tool alignment during tail-bending operation.

In one embodiment of the invention, the outward directed bending face of the bending anvil is provided with grooves which extend at right angles to the lengthwise direction of the bending anvil and each accommodate a free leg of a connection pin. In this way the connection pins accommodated in the grooves are shielded from external forces.

If the housing of the connector is provided with a number of rows of connector elements, and the connection pins thereof are arranged in rows and in positions staggered from row to row, in one embodiment of the invention the outward directed bending face of the bending anvil is provided with grooves which extend at right angles to the lengthwise direction of the bending anvil and each accommodate a free leg of a connection pin, and the depth of the grooves intended for the connection pins of one row differs from the depth of the grooves for the connection pins of the adjacent row.

In order to ensure that the connection pins are bent accurately at right angles with a predetermined curvature, the bottom of each groove passes gradually by way of a curved part into the appropriate bore in the positioning element.

In order to prevent the connection pins from springing back slightly after bending thereof, the bottom of the part of the groove connecting to the curved part is deeper than the highest point of the face of the curved part. This means that the pins can be pressed slightly further during the bending in order to allow a more than 90° bent to correct for material spring-back.

The positioning element and the bending anvil preferably form one unit, so that mounting of the positioning element and the anvil can be carried out in one operation.

In order to retain the free leg of the connection pins better in the correctly aligned position, the connection pins are placed in the grooves at least locally in a press fit. This press fit is obtained by an under-sized (IDC-type) slot, the bottom of which forms the bending surfaces, to permit final location/trapping of bent tail as close as possible to the appropriate holes in the PCB. This feature is of relevance to ensure good pin-tip true-position of slender right-angle bent tails, and also impart a rigidity to tail-structures of the final connector.

The forces of the bending of the connection pins in the grooves can be reduced, so that at least one wall of the grooves near the exit point of the free leg of the connection pins has a thickened part running at right angles to the bottom of the groove.

In an embodiment which is preferably used, the free leg of the connection pins in the bent state grips behind at least one wall thickened part of the corresponding groove. This means that the free leg will rest with some pre-tension against the thickened part, with the result that the accurately aligned position of the soldering end of the connection pin is maintained, while in addition the soldering end cannot be pulled out of the groove accidentally.

Opposite of the curved bending face the channel in the anvil has a slanting chamfer 28 to appropriately engage with the teeth of a mass bend tool so that an accurate aligning during tail bending operation is achieved.

In order to absorb lateral forces during the bending operation, a fixed position of the positioning element and anvil is maintained, through the fact that the face of the positioning element facing the connection pin output side of the connector is provided with flanges which extend at right angles to said element face and grip over the corresponding side faces of the connector housing.

The invention also relates to a bending mandrel for interacting with the bending anvil to bend the connection pins of the connector, which mandrel is characterized in that the outward facing bending face of the bending anvil and the bending face of the mandrel interacting therewith complement each other in shape.

In one embodiment of the bending mandrel, the bending face of the mandrel is provided with ribs standing up at right angles to the bending face, the thickness of which ribs corresponds to the width of the grooves in the bending face of the bending anvil, and the rib consisting of a first part with an edge running parallel to the bending face of the mandrel and a second part connecting thereto and having a curved edge in which the radius of curvature corresponds to that of the curved part of the groove in the bending face of the bending anvil.

In a further development thereof, the curved part of the rib ends in a peak-shaped part, and at the side of the bending anvil lying opposite the curved groove part the bore in the positioning element and bending anvil for passing through of the connection pins widens out at an angle corresponding to the angle of the outside of the peak.

Since the positioning element and bending anvil can be supplied loose, rights are hereby being applied for in respect of these components or this combination of components which are intended for a connector according to the invention.

The invention will be explained in greater detail below with reference to the drawings. In the drawings.

Figures 1, 2, 3, 4, 5:
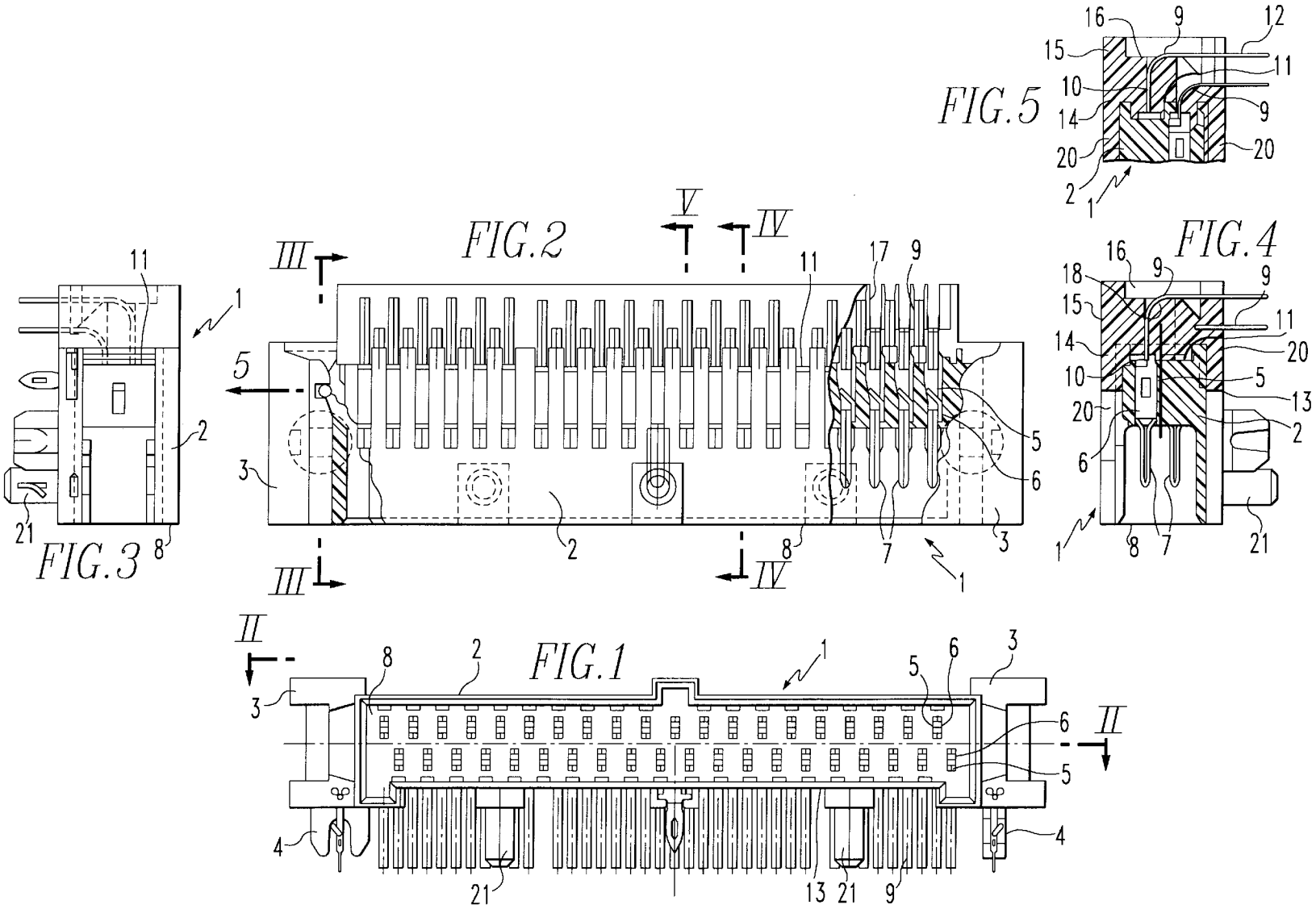
FIG. 1 shows a view of the connection side of an embodiment of the connector according to the invention.
FIG. 2 shows a side view partially in section of the embodiment according to FIG. 1, viewed towards the side facing the printed circuit board.
FIG. 3 shows a section along the line III—III of FIG. 2.
FIG. 4 shows a section along the line IV—IV of FIG. 2.
FIG. 5 shows a section along the line V—V of FIG. 2.

FIGS. 1–5 and 9 show an electrical connector according to a preferably used embodiment of the invention. This connector 1 comprises a housing 2 of electrically insulating material, preferably plastic. The housing 2 is provided with flanges 3, which are provided with fixing elements 4. Channels 5 containing contact elements 6 are accommodated in the housing 2. These are seen most clearly in FIG. 9, which is drawn on an enlarged scale. In the case of this embodiment, two rows of channels 5 and contact elements 6 accommodated therein are used. The positions of the channels 5 of one row are staggered in the direction of the row relative to the positions of the channels 5 in the other row. It is clear that any configuration of channel positions is possible, e.g. one row or more than two rows, with channel positions staggered or otherwise.

The contact elements are of electrically conducting material and have contact ends 7 which in the embodiment shown are in the form of contact pins 7 for contacting sockets of a further connector. Said contact pins 7 are situated in a space which is surrounded by walls of the housing 2, but are accessible from the contact side 8 for the sockets and a part of a further connector. In this case it will be a further connector with sockets, and a part of the housing of the further connector is accommodated in the abovementioned space in order to slide the sockets over the contact pins 7.

At the end situated opposite the contact pins 7, the contact elements 6 have a connection end which is provided with L-shaped connection pins 9 for mounting on a printed circuit board. The connection pins 9 consist of a fixed leg 10 which is connected to the corresponding contact element 6 and a free leg 12 situated at right angles thereto. Said connection pins 9 extend outwards with the one fixed leg 10, from the connection pin output side 11 of the housing 2 lying opposite the contact side 8, in the direction of the contact element 6. The free legs 12 of the connection pins 9 extend essentially at right angles to the legs 10 thereof until they are beyond the connection side 13 of the connector housing 2. The connection side 13 of the housing 2 runs at right angles to the connection pin output side 11 and the contact side 8 of the connector housing 2.

At the connection pin output side of the connector housing 2, the electrical connector 2 is also provided with a positioning element 14 and a bending anvil 15, which in the preferred embodiment shown form one unit. The positioning element 14 and the bending anvil 15 are made of electrically insulating material and serve to hold in position the connection pins 9, which for that purpose are passed through bores 16 (see in particular FIG. 9).

As already stated, the positioning element 14 and the bending anvil 15 form one unit, i.e. positioning and bending element, which has the advantage that this unit can be slid over the pins in one operation.

One side of the positioning element 14 thus adjoins the connection pin output side 13, while the fixed legs 10 adjoining the connection end of the contact elements 6 run through the bores or channels 16 of the positioning element 14. The bending anvil 15, in this case the combined positioning and bending element, is used for bending the connection pins 9 to an L-shape. Bending thereof is achieved by means of a bending mandrel, a preferred embodiment of which will be described further on. During the bending, the fixed leg is retained in the bore 16 of the positioning element 14. After the bending of the connection pins, the positioning element 14 and the bending anvil 15 remain in the final position. Without further additional action, the electrical connector 1 can be placed on a printed circuit board, the soldering ends of the connection pins being inserted through holes in the printed circuit board, following which said soldering ends can be soldered to the contact faces on the printed circuit board.

The outward directed bending face 16 (see FIGS. 4 and 5) of the bending anvil 15 is provided with grooves 17, extending at right angles to the lengthwise direction of the bending anvil. The width of the grooves corresponds to the width of the free leg 12 of the connection pin 9 to be accommodated therein. Due to the fact that the connection pins 9 are for the most part accommodated in the corresponding grooves 17, the connection pins 9 are well shielded from external forces, with the result that the correct position of the free leg 12 of the connection pins 9 is accurately maintained. The depth of the grooves depends on the chosen configuration of the holes in the printed circuit board through which the soldering ends of the connection pins 9 have to be inserted. In connection with miniaturization, a staggered configuration has been selected, and the same applies to the configuration of the positions of the contact elements. Of course, any configuration is possible, e.g. a configuration of holes lying in one row in the printed circuit board, or various rows with holes which are not staggered. In the case of the preferred embodiment shown in the figures, the staggered configuration has been selected, and the depth of the grooves for the connection pins 9 of one row are deeper than the grooves for accommodating the connection pins in the other row.

The bottom of each groove 17 merges by way of a curved part 18 into the bore 16 in the positioning element. This produces a bending face for the connection pins 9, which ensures well-defined bending of the connection pins 9. The part of the groove opening out at the connection side of the connector preferably lies slightly deeper than the curved part 18. This measure facilitates accurate bending of the connection pins 9 at the position of the bend between the two legs 10 and 12 thereof.

Figure 15:
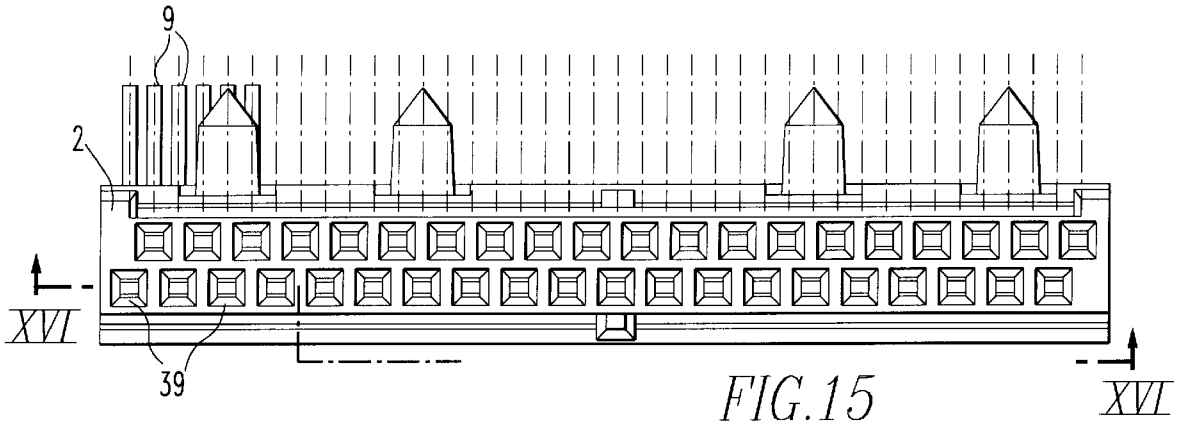
FIG. 15 shows an embodiment of the connector according to the invention with sockets.
Figure 16:
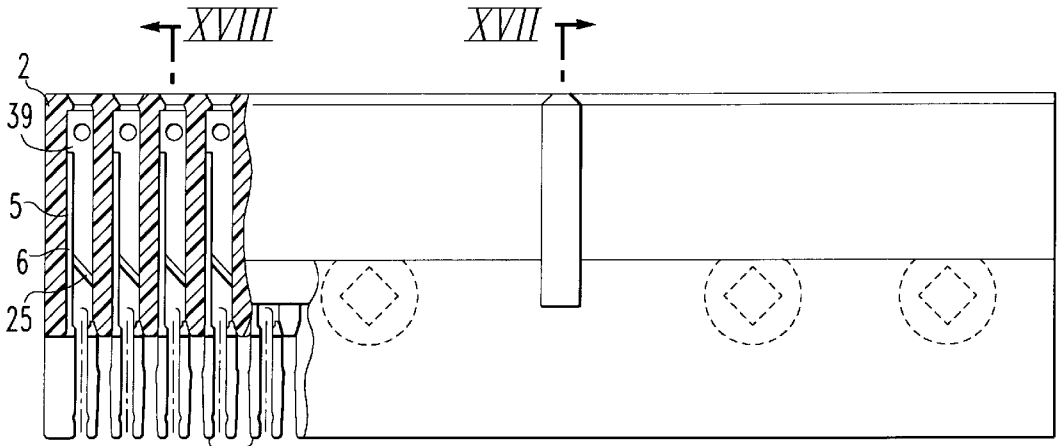
FIG. 16 shows a side view, partially in section, of the embodiment of FIG. 15.
Figure 18:
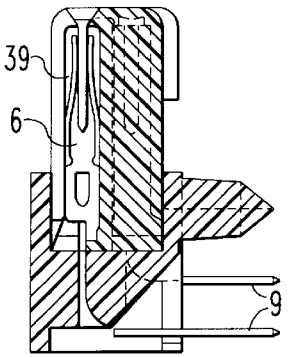
FIG. 18 shows a section along the line XVIII—XVIII of FIG. 16.
Figure 17:
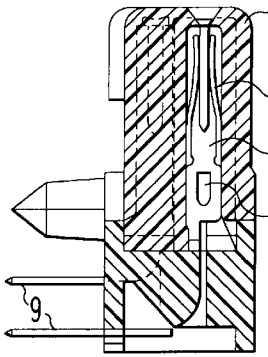
FIG. 17 shows a section along the line XVII—XVII of FIG. 16.

In order to retain the free legs 12 of the connection pins 9 (see also FIGS. 13 and 15) accurately in the correctly aligned position, the width of the groove is at least locally so narrow that therein the free legs 12 are clamped in the correctly aligned position after the bending operation. This narrowing can be continued in a manner not shown by providing at least one of the walls of the grooves near the exit point of the free leg 12 of the connection pins 9 with a narrow thickening rib positioned at right angles to the bottom of the groove.

In the case of the embodiment shown in the drawing, a thickened part 19 (see FIGS. 9 and 10) is provided in the walls of the grooves, behind which the free leg of the connection pins 9 grips after bending. If after the bending operation the free leg 12 has a slight tendency to spring back, the free leg is pressed with a pre-tension against the thickened part, in which case an accurately aligned position of the free leg of the connection pin is ensured.

Figure 11:
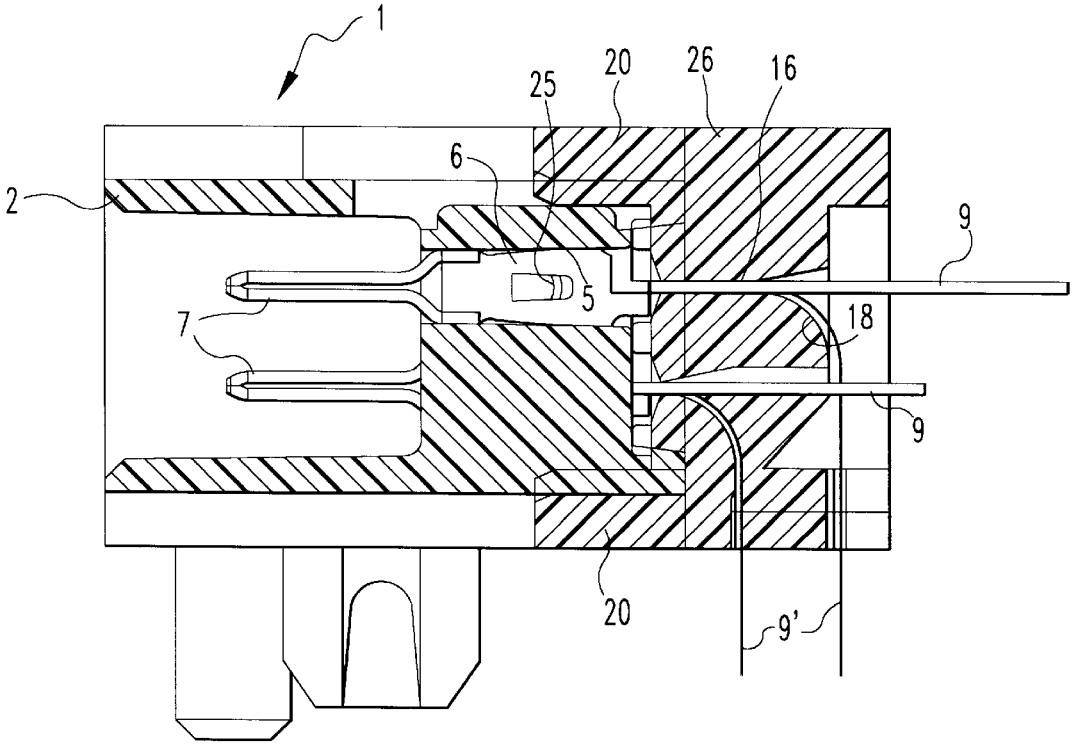
FIG. 11 shows the parts of FIG. 10 inserted into each other.

The positioning element 14 is also provided with flanges 20 (see FIG. 11) which during placing of the positioning element slide over the appropriate faces of the connector housing. In this way it is ensured that the positioning element 14 and the bending anvil 15 or combined element also continue to assume a well-defined fixed position during bending of the connection pin. For, the lateral components of the bending forces are absorbed by the flanges. If, as in the preferred embodiment, the positioning element 14 and the bending anvil 15 form one unit, the well-defined fixed position of the bending anvil 15 is thereby ensured automatically without additional measures.

The connector housing 2 is also provided with fixing means 21 (see FIGS. 1 and 3) for fixing the connector on the printed circuit board. This means that any forces exerted on the connector do not have to be absorbed by the connection pins 9 alone.

Figure 8:
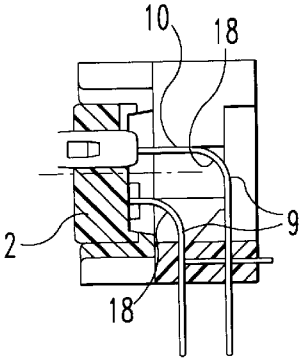
FIG. 8 shows a section along the line VIII—VIII of FIG. 6.
Figure 6:
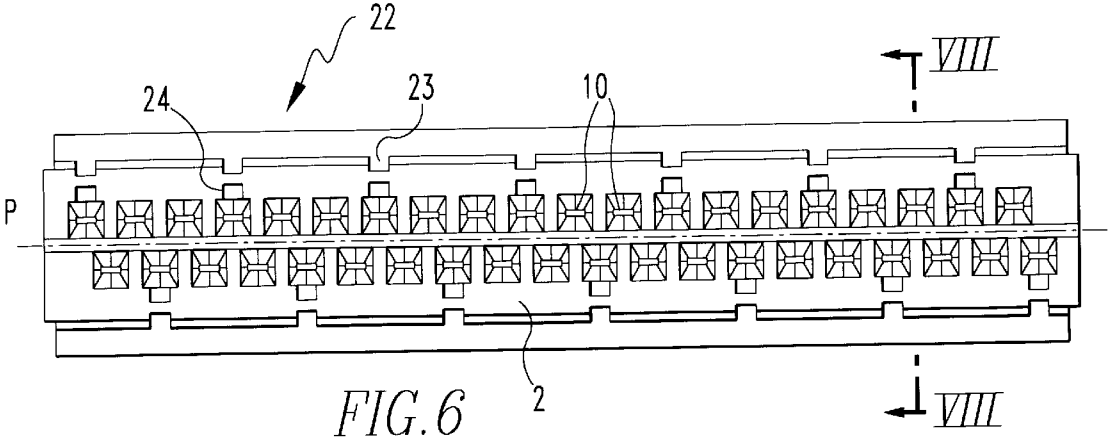
FIG. 6 shows a view of the positioning element and bending anvil according to an embodiment of the invention viewed at the insertion side for the connection pins, as indicated by arrow P in FIG. 7.
Figure 7:
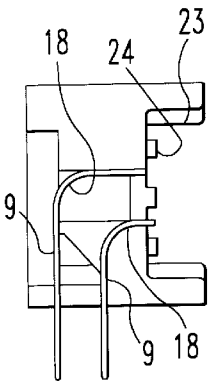
FIG. 7 shows a side view of the embodiment according to FIG. 6.
Figure 9:
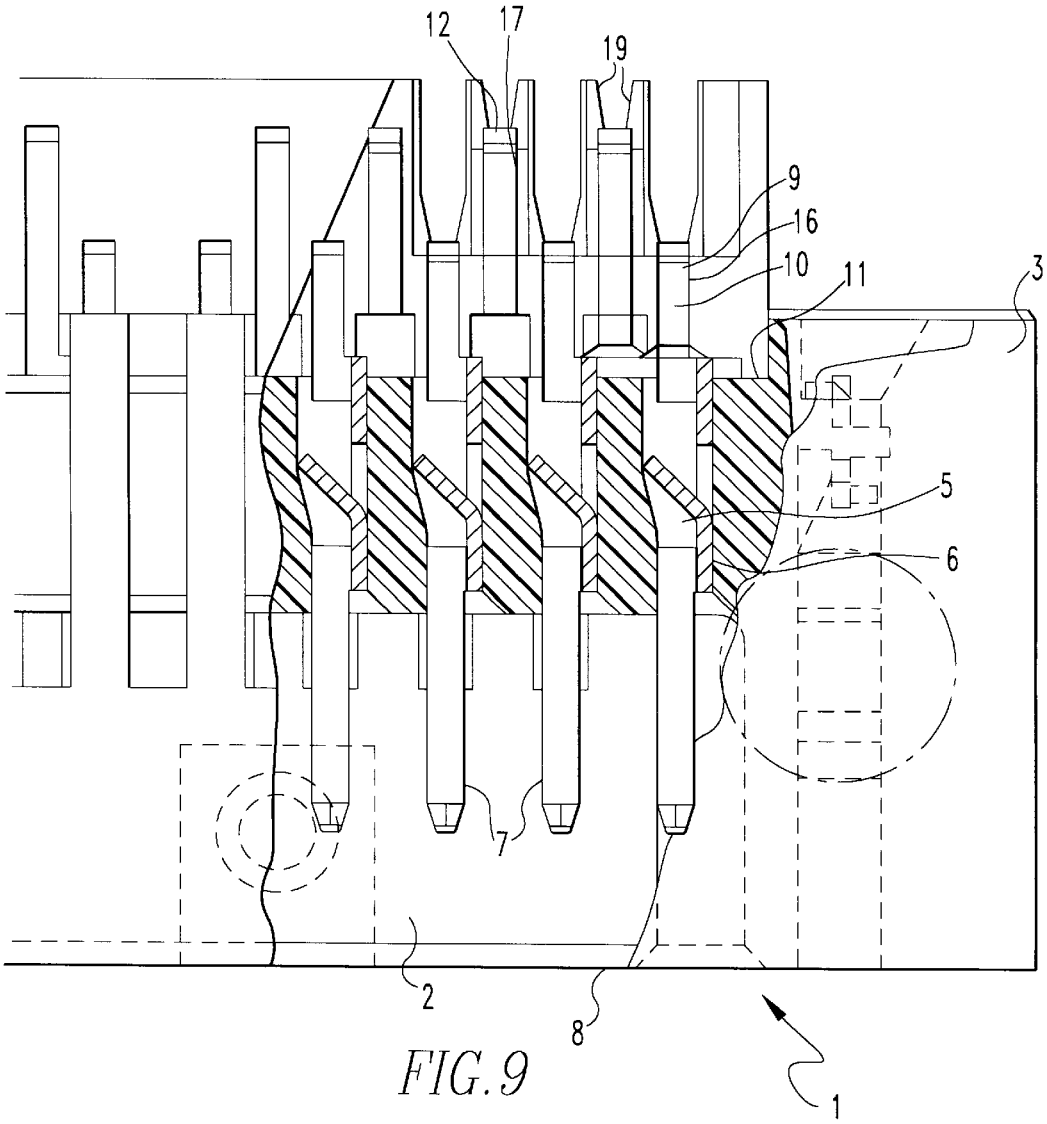
FIG. 9 shows on an enlarged scale the sectioned part of the embodiment of FIG. 2.

FIGS. 6, 7 and 8 show the positioning element and the bending anvil designed in one piece as a positioning and bending element 22. At the side facing the connector housing and from this side onwards, the bores 10 are tapered in order to facilitate insertion of the connection pins 9 into the bores 10. For purposes of clarification, the connection pins 9 are shown in FIG. 7, and the connection pins 9 and a part of the connector 2 are shown in FIG. 8. The curved parts of the grooves in the bending face of the positioning and bending element are clearly visible in FIGS. 7 and 8. The positioning and bending element 22 has flanges 20, and projections 23 are provided in the inside wall, which projections interact with slits in the corresponding walls of the connector housing 2. This means that the positioning and bending element is also held well in position in the lengthwise direction during the bending operation of the connection pins 9. Moreover, the lobes 24 on the underside of the positioning and bending element 22 have the same function. It can also be seen clearly from these figures that the grooves are alternately of different depths.

The function of the positioning and bending element will now be explained with reference to FIGS. 10, 11, 12, 13 and 14.

Figure 10:
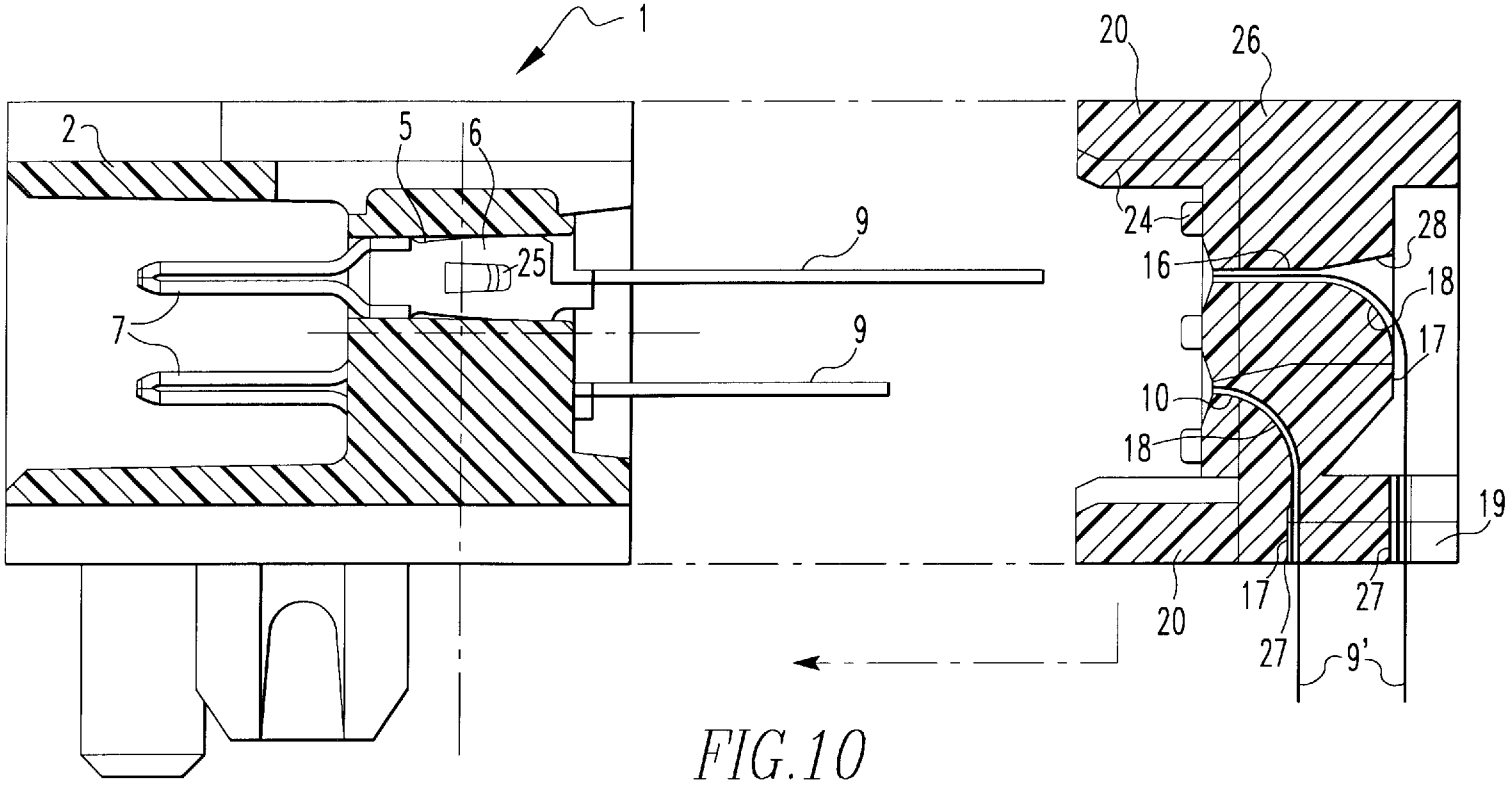
FIG. 10 shows on the left side a cross-section of an embodiment of the connector according to the invention and on the right side a cross-section through the positioning element and bending anvil to be inserted thereon.

On the left in FIG. 10, the connector 1 is shown in cross-section through one of the connector elements 6, which connector has a housing 2. The housing 2 is provided with two rows of channels 5, in which the connector elements 6 are accommodated. These connector elements 6 are provided with a lip 25 which engages on a wall of the channel 5 in order to lock the connector element 6 in the channel. At the contact side, the connector element 6 is provided with a contact pin 7 and at the connection side is provided with a connection pin 9, which in FIG. 10 is still in the extended position.

The positioning and bending element 26 is illustrated on the right FIG. 10. This element 26 is provided with bores 16 for the accommodation of connection pins 9. The bores 16 merge by way of a curved part 18 into the straight part 17 of groove disposed in the bending face for bending, by means of a bending mandrel, the connection pins 9 inserted through the bores 16, and for shielding and possibly locking the free legs of the connection pins 9. It can be seen clearly in FIG. 10 that the straight parts 27 or the grooves 17 are lower than the highest point of the curved part 18. It can also be seen from FIG. 10 that the bore 16 tapers (28) in the direction of the bending face at the other side of the curved part 18. The slanting chamfer 28 functions as a surface engaging appropriately with the teeth of a bend tool (see FIG. 12), by which an accurate alignment during tail bending operation is achieved. For the sake of clarity. the connection pins 9 are shown diagrammatically in the positioning and bending element 26 by its axis 9'.

The bore 16 tappers at the pin input side or collecting adequately the pins even if some pins could have a misposition.

The element 26 has flanges 20 which have to grip over the side faces of the connector 2. The lobes 24 serve to ensure the fixed position of the element 26 on the connector housing 2.

Fig, 11 shows the manufacturing phase, in which the positioning and bending element 26 has been fitted on the connector housing 2. The connection pins 9 then run through the bores 16 in the element 26. For the sake of clarity, the bent position of the connection pins 9 is indicated diagrammatically by its axis 9'.

Figure 12:
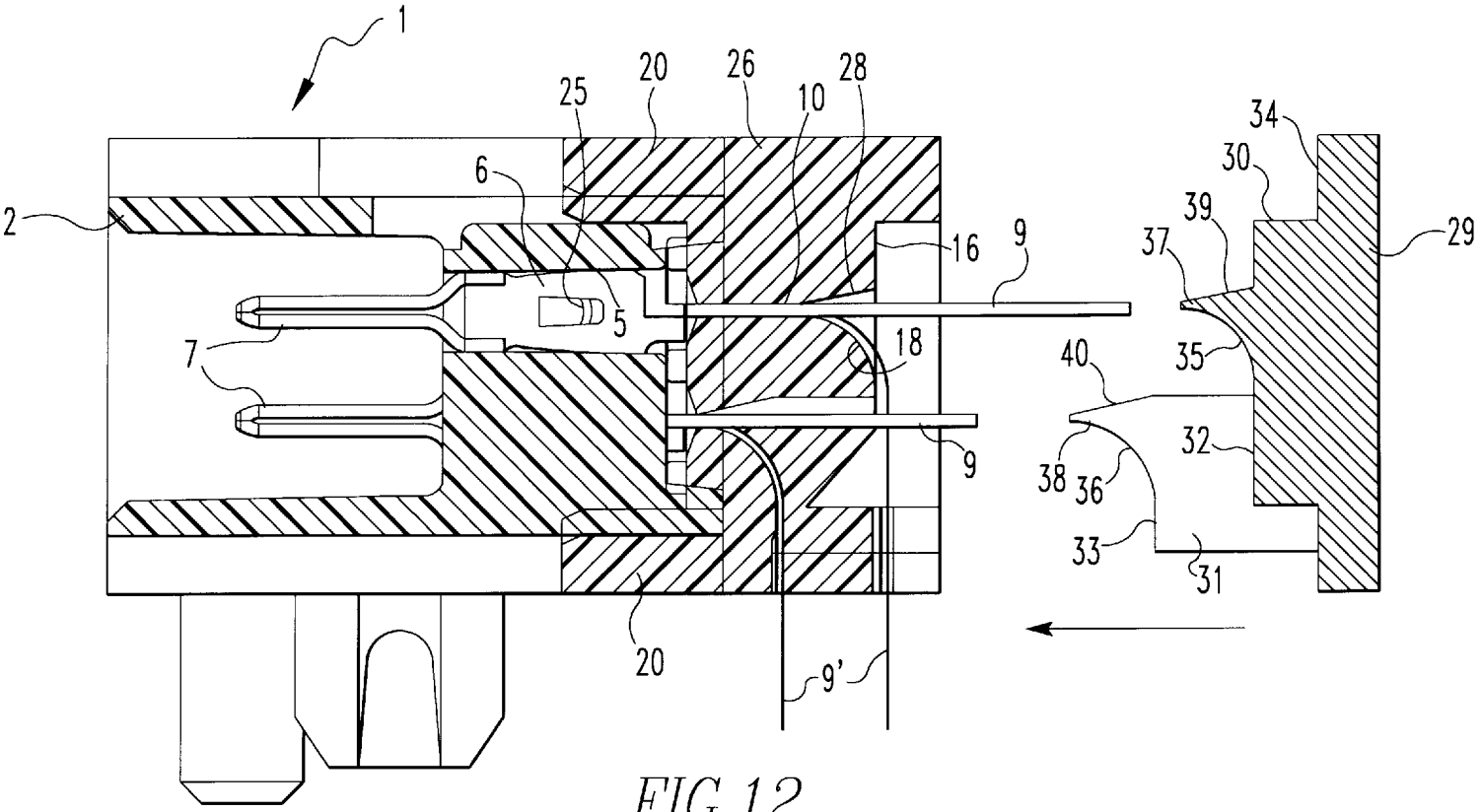
FIG. 12 shows on the left the embodiment of FIG. 11 and on the right in section a bending mandrel for bending the connection pins of the connector according to the invention.

FIG. 12 shows on the left the assembled connector 1 and positioning and bending element 26 and of the bending mandrel 29 is shown on the right of this figure. It can be seen clearly from FIG. 12 that the bending face of the element 26 and of the bending mandrel 29 are complementary. In particular, the bending mandrel 29 is provided with ribs 30 and 31 which stand up perpendicular to the bending face and fit into the corresponding grooves in the bending face of the positioning and bending element 26. The rib 31 projects more relative to the face 34 than the rib 30, because the groove for the bottom connection pin 9, which is also shorter than the connection pin 9 lying above it, lies deeper than the groove for the top connection pin 9. The thickness of the ribs is a fraction smaller than the width of the grooves in the bending face of the element 26. Each rib 30, 31 consists of a first part 32, 33 of which the outside edge runs parallel to the bending face 34 of the bending mandrel 29. Connecting to the abovementioned straight parts 32, 33 of the ribs is a second part 35, 36 respectively, the edge of which is curved with a radius of curvature corresponding to that of the curved part 18 of the groove in the bending face of the element 26. The curved rib parts 35 and 36 end in peaks 37, 38. The faces 39 and 40 lying opposite the curved faces of the peaks 37, 38 respectively lie at an angle which corresponds to the angle of the tapering parts 28 adjoining the bores 10 of the element 26.

In order to bend the connection pins 9 at right angles, the mandrel 29 is pressed onto the bending face 16 of the positioning and bending element 26. During this bending operation, the connection pins 9 are guided along the rib edges 35, 32 and 36, 33 respectively and held in the correct plane by the walls of the grooves in the element 26.

Figure 13:
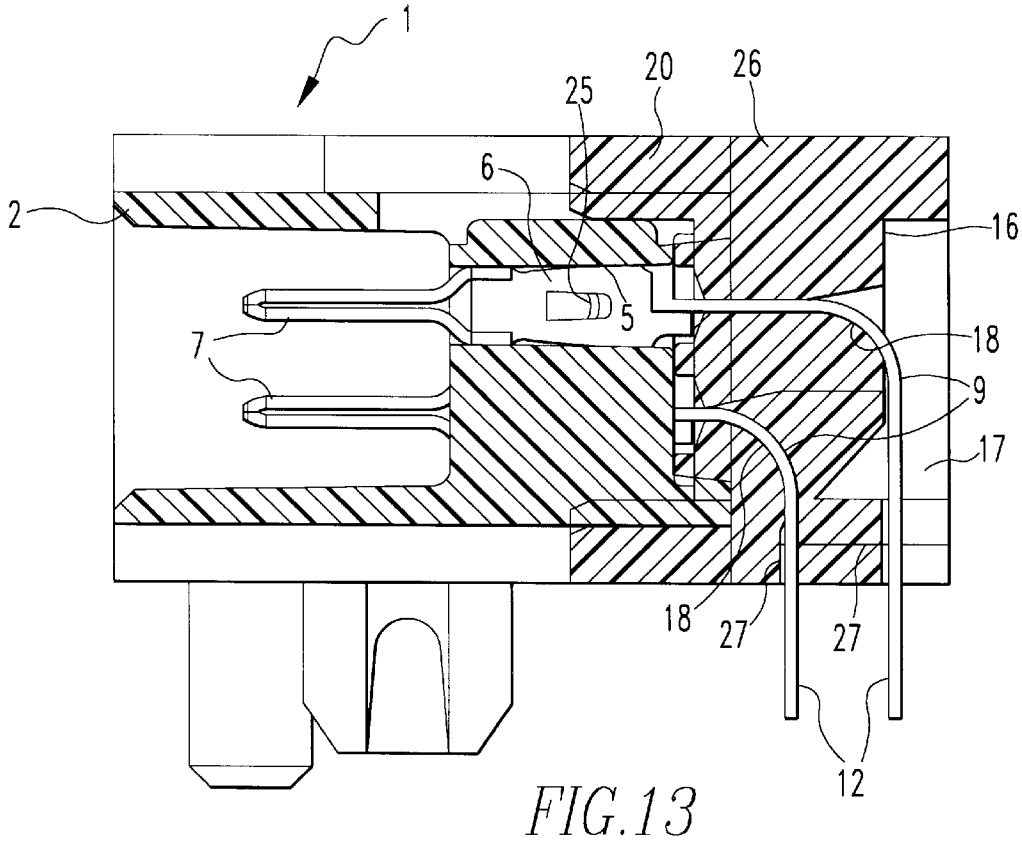
FIG. 13 shows a finished embodiment of the connector and positioning element and bending anvil according to the invention.

The finished assembly of connector 1 and a positioning and bending element 26 is shown in FIG. 13. In this case the connection pins 9 are lying confined in the grooves of the element 26. In this position the free legs of the connection pins grip behind the thickened parts 19 in the walls of the grooves 17, which can be seen clearly in FIG. 9.

Figure 14:
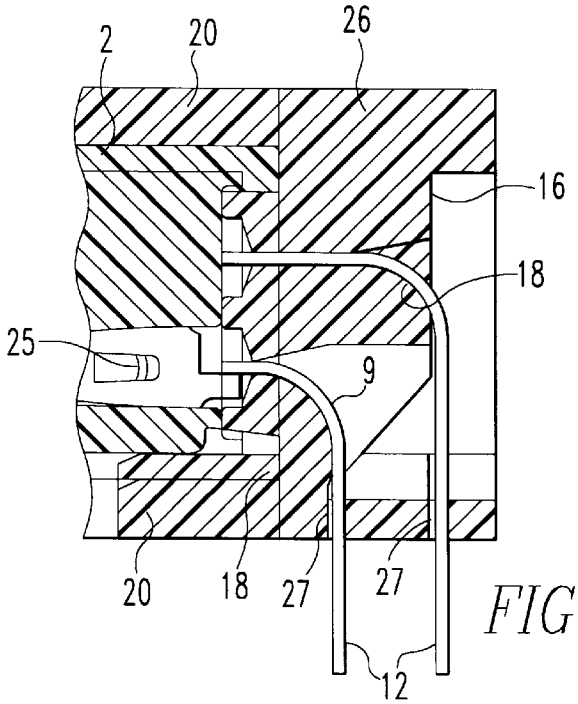
FIG. 14 shows a partial section through a contact element of the connector according to FIG. 13 which is adjacent to and is situated in the adjacent row.

FIG. 14 shows a section through a contact element 6 of the bottom row.

It can be seen clearly from the drawings that in the bent state the connection pins rest against the curved parts 18 of the grooves in the element 26. However, the free legs 12 of the connection pins 9 bent to an L-shape lie at a short distance from the bottom of the straight part 27 of the grooves 17, in the bending face of the element 26. This distance makes accurate bending of the connection pins 9 possible and ensures that after the bending operation the free legs of the connection pins 9 do not spring back too far, so that an accurately aligned position of the soldering ends of the connection pins 9 is achieved.

FIGS. 15, 16, 17 and 18 show another embodiment of the connector according to the invention. In the case of this embodiment contact elements 6 which are provided with sockets 39 at the contact side of the connector 2 are used. In the case of this embodiment also, lips 25 are punched out of the body of the contact element 6 and bent in order to lock the contact elements 6 in the corresponding channels 5.

The parts of the connector and the positioning and bending element which are not mentioned in the description with reference to FIGS. 10–18 correspond to identical parts of FIGS. 1–9, so that they will not be discussed any further.

It emerges clearly from the above description that the invention is based on the idea of combining the wafer function and bending function, with the result that a connector with bending wafer is achieved, by means of which the soldering ends of the connection pins of the connector are held in the accurately aligned positions, and circumstances during manufacturing of packaging, storage, transportation and mounting have no adverse effect on the correct alignment. The manufacture of the connector, the mounting thereof on the printed circuit board and the subsequent soldering process are also simplified.

I claim:

1. An electrical connector, comprising a housing (2) of electrically insulating material with a connection side (13), a connection pin output side (11) and a contact side (8) and provided with a number of contact elements (6) of electrically conducting material accommodated in channels (5) and, each with a contact end (7) situated at the contact side (8) of the housing (2), for contacting a further connector, and a connection end provided with an L-shaped connection pin (9), having a fixed leg (10) fixed to the connection end of the contact element (6) extending from the connection pin output side (11) of the housing (2) lying opposite the contact side (8), a bend and a free leg (12) for mounting on a printed circuit board substantially perpendicular to the fixed leg (10) and extending to beyond the connection side (13) of the housing (2) running at right angles to the connection pin output side (11), and comprising a bending anvil having a curved bending face (18) for bending the connection pins (9) to an L-shaped, characterized in that the bending anvil is separated from the connector housing (2) and is provided with a positioning element (14) of electrically insulating material between the connection pin output side (11) and the bending anvil, said positioning element (14) has bores (16) extending perpendicular to the plane of the connection pin output side (11) of the connector housing (2) for accommodating and supporting the fixed legs (10) of the connection pins (9) that the bores (16) merge into the respective curved bending faces (18) of the anvil such that the bore openings are immediately adjacent to the beginning of the corresponding curved bending faces (18); that the opposite bore openings are tapered and that the positioning element (14) is provided with aligning and positioning means (20, 23) for aligning it to the connector housing (2), and the face of the positioning element (14) facing the connection pin output side (13) is provided with flanges (20) which extend at right angles to said element face and grip over the corresponding side faces of the connector housing (2).

2. The connector according to claim 1, wherein the curved bending face (18) of the bending anvil is the bottom face of grooves (17) having walls parallel to the axes of the bores (16) in the positioning element (14), each said groove (17) accommodating a free leg of a connection pin.

3. The connector according to claim 1, wherein the connector housing (2) Is provided with a number of rows of connector elements (6), and the connection pins (9) thereof are arranged in rows and in positions staggered from row to row, wherein the bores have the corresponding staggered positions wherein the curved bending face (18) of the bending anvil is provided with grooves (17) which extend at right angles to the lengthwise direction of the bending anvil and each accommodate a free leg (12) of a connection pin (9), and wherein the distance of the grooves (17) intended for the connection pins of one row differs from that of the grooves (17) for the connection pins of the adjacent row from the connection pin output side (11) of the connector housing (12).

4. The connector according to claim 2, wherein the bottom of each groove (17) passes gradually by way of a curved part into the appropriate bore (16) in the positioning element (14) and that each groove (17) extends further to the plane of the connection side (13) of the housing (2).

5. The connector according to one of claim 1, wherein the positioning element (14) and the bending anvil form one unit.

6. The connector according to claim 2 wherein the grooves are provided with means for press fitting the connection pins (9) at least locally.

7. The connector according to claim 6, wherein at least one wall of the grooves (17) near the exit point of the free legs (12) of the connection pins (9) has a thickened part running at right angles to the bottom of the grooves (17).

8. The connector according to one of claim 1, wherein in the bent position the free leg of the connection pins grips behind at least one wall thickened part of the corresponding groove.

9. The connector according to claim 1, wherein the bore (16) of the positioning element (14) for accommodating the respective connection pin (9) tappers at the insert side.

10. The connector according to claim 1, wherein the face or the bore (16) opposite of the bending face (18) of the anvil is constituted by a chamfer (28).

* * * * *